US011378079B2

(12) United States Patent
Moon et al.

(10) Patent No.: US 11,378,079 B2
(45) Date of Patent: Jul. 5, 2022

(54) ROTARY VANE COMPRESSOR WITH A STEP IN THE BEARING ADJACENT THE RAIL GROOVE

(71) Applicant: LG ELECTRONICS INC., Seoul (KR)

(72) Inventors: Seokhwan Moon, Seoul (KR); Jinung Shin, Seoul (KR); Kiyoul Noh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/099,943

(22) Filed: Nov. 17, 2020

(65) Prior Publication Data

US 2021/0301662 A1 Sep. 30, 2021

(30) Foreign Application Priority Data

Mar. 27, 2020 (KR) ..... 10-2020-0037805

(51) Int. Cl.
*F04C 18/32* (2006.01)
*F01C 21/08* (2006.01)
(Continued)

(52) U.S. Cl.
CPC ..... *F04C 18/321* (2013.01); *F01C 21/02* (2013.01); *F01C 21/0809* (2013.01); *F01C 21/0836* (2013.01); *F04C 29/12* (2013.01)

(58) Field of Classification Search
CPC ..... F01C 1/324; F01C 21/02; F01C 21/0809; F01C 21/18; F01C 21/086; F04C 18/324; F04C 29/12; F04C 18/321
See application file for complete search history.

(56) References Cited

U.S. PATENT DOCUMENTS 5,560,741 A * 10/1996 Edwards ..... F01C 21/0809 418/141
8,985,983 B2 * 3/2015 Yang ..... F01C 21/0809 418/260

FOREIGN PATENT DOCUMENTS

KR 10-2012-0112790 10/2012
KR 10-2018-0080885 7/2018
WO WO-2004036046 A1 * 4/2004 ..... F04C 18/3442

OTHER PUBLICATIONS

Machine Translation of Korean Patent Publication KR20180080885 A, Inventor: Hwan et al, Published Jul. 13, 2018. (Year: 2018).*
(Continued)

*Primary Examiner* — Mary Davis
(74) *Attorney, Agent, or Firm* — KED & Associates

(57) ABSTRACT

A rotary compressor may include a rotational shaft; first and second bearings that support the rotational shaft in a radial direction; a cylinder disposed between the first bearing and the second bearing, and forming a compression space; a rotor forming a contact point, disposed in the compression space, and having a predetermined gap with the cylinder, and coupled to the rotational shaft to compress refrigerant according to rotation; and at least one vane slidably inserted into the rotor, and contacting an inner circumferential surface of the cylinder to separate the compression space into a plurality of regions. Each of the at least one vane may include an upper pin that extends upward, and a lower pin that extends downward, a surface of the first bearing may include a first rail groove into which the upper pin may be inserted, and a first step disposed adjacent to the first rail groove, and a surface of the second bearing may include a second rail groove into which the lower pin may be inserted, and a second step disposed adjacent to the second rail groove.

17 Claims, 11 Drawing Sheets

(51) Int. Cl.
*F01C 21/02* (2006.01)
*F04C 29/12* (2006.01)

(56) References Cited

OTHER PUBLICATIONS

Machine Translation of Korean Patent Publication KR20120112790 A, Inventor: Helle et al, Published Oct. 11, 2012. (Year: 2012).*

* cited by examiner

ROTARY VANE COMPRESSOR WITH A STEP IN THE BEARING ADJACENT THE RAIL GROOVE

CROSS-REFERENCE TO RELATED APPLICATION(S)

This application claims priority under 35 U.S.C. § 119 to Korean Application No. 10-2020-0037805, filed in Korea on Mar. 27, 2020, whose entire disclosure(s) is/are hereby incorporated by reference.

BACKGROUND

1. Field

A rotary compressor, and more particularly, a vane rotary compressor in which a compression chamber is formed while a vane protrudes on a rotating rotor to be in contact with an inner circumferential surface of a cylinder is disclosed herein.

2. Background

In general, a compressor refers to a device that receives power from a power generating device, such as a motor or a turbine, to compress a working fluid, such as air or refrigerant. More specifically, the compressor is widely applied to home appliances, in particular, a steam compression type refrigeration cycle (hereinafter, referred to as a 'refrigeration cycle').

The compressor may be classified into a reciprocating compressor, a rotary compressor, and a scroll compressor according to a method of compressing a refrigerant. The rotary compressor may be classified into a method in which a vane is slidably inserted into a cylinder to be in contact with a roller and a method in which the vane is slidably inserted into the roller to be in contact with the cylinder. In general the former is referred to as a "rotary compressor", while the latter is referred to as a "vane rotary compressor".

In the rotary compressor, the vane inserted into the cylinder is drawn out toward the roller by an elastic force or back pressure to be in contact with an outer circumferential surface of the roller. In contrast, in the vane rotary compressor, the vane inserted into the roller is drawn out by a centrifugal force and the back pressure while rotating together with the roller to be in contact with an inner circumferential surface of the cylinder.

In the rotary compressor, compression chambers as many as the vanes per rotation of the roller are independently formed and respective compression chambers simultaneously perform suction, compression, and discharge strokes. In contrast, in the vane rotary compressor, compression chambers as many as the vanes per rotation of the roller are continuously formed and respective compression chambers sequentially perform suction, compression, and discharge strokes.

In the vane rotary compressor, in general, as a front end surface of the vane slides while being in contact with the inner circumferential surface of the cylinder while a plurality of vanes rotates together, friction loss increases compared with a general rotary compressor. Further, in the vane rotary compressor, the inner circumferential surface of the cylinder has a circular shape, but in recent years, a vane rotary compressor (hereinafter, referred to as a "hybrid rotary compressor") has been introduced, which includes a so-called "hybrid cylinder" in which the inner circumferential surface of the cylinder has an oval shape or a shape in which an ellipse and a circle are combined to reduce friction loss and increase compression efficiency.

In the hybrid rotary compressor, a position where a contact point for dividing a region where the refrigerant enters and the compression stroke starts due to a characteristic in which the inner circumferential surface of the cylinder has an asymmetric shape and a region where the discharge stroke of the compressed refrigerant is performed is formed exerts a significant influence on efficiency of the compressor. In particular, in a structure in which an inlet and an outlet are sequentially formed adjacent to each other in a direction opposite to a rotational direction of the roller in order to achieve a high compression ratio by increasing a compression path as much as possible, the position of the contact point exerts a large influence on the efficiency of the compressor. However, compression efficiency is reduced by contact of the vane and the cylinder and a reliability problem occurs due to abrasion.

BRIEF DESCRIPTION OF THE DRAWINGS

Embodiments will be described in detail with reference to the following drawings in which like reference numerals refer to like elements, and wherein.

DETAILED DESCRIPTION

Figure 1:
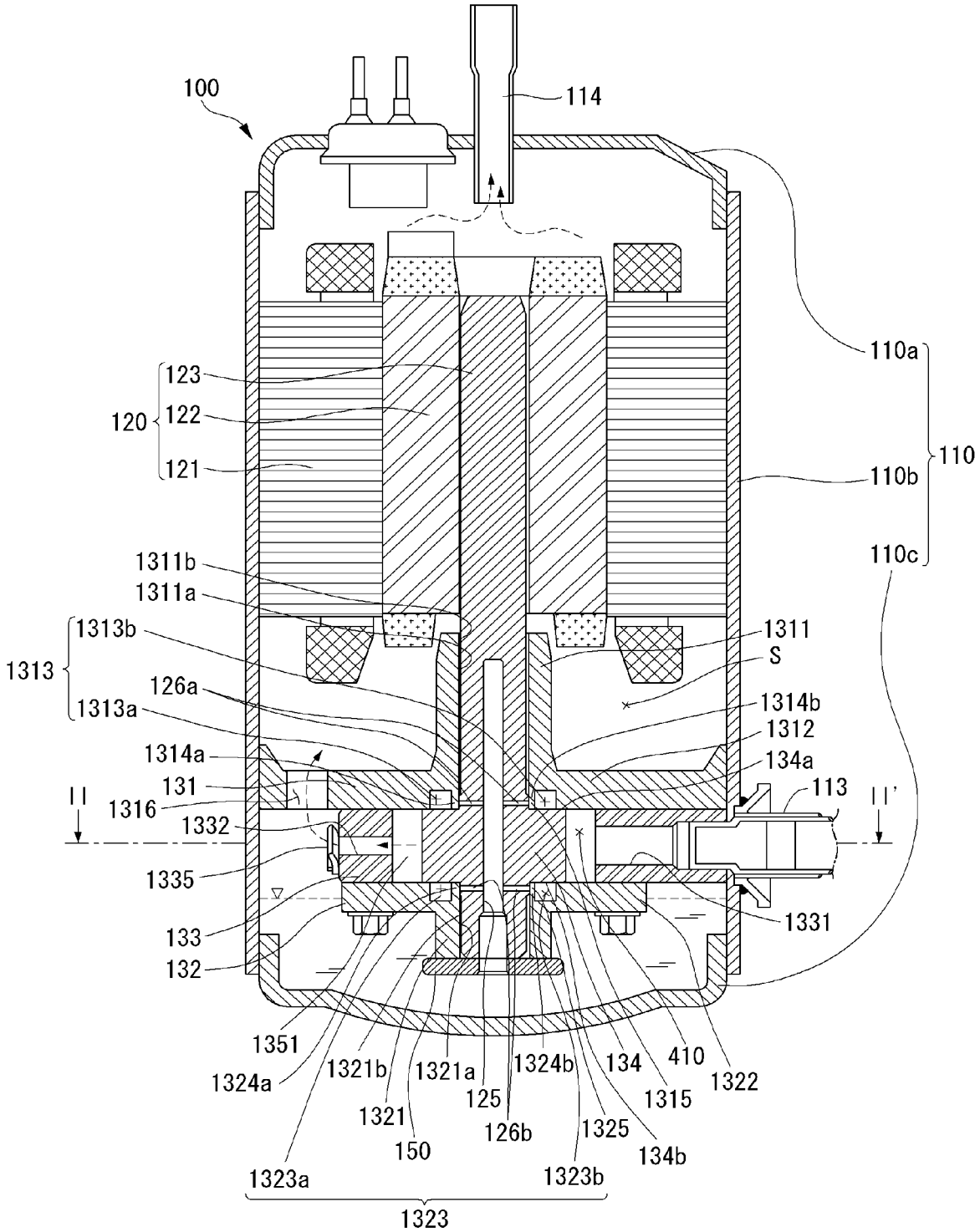
FIG. 1 is a longitudinal cross-sectional view of a rotary compressor according to an embodiment.

Hereinafter, embodiments will be described with reference to the accompanying drawings. The same or similar components are denoted by the same or similar reference numerals, and repetitive description thereof has been omitted.

In describing embodiments, it should be understood that, when it is described that a component is "connected to" or "accesses" another component, the component may be directly connected to or access the other component or a third component may be present therebetween. Further, in describing an embodiment, a detailed description of related known technologies will be omitted if it is determined that the description makes the gist of the embodiment unclear. Further, it is to be understood that the accompanying drawings are just used for easily understanding embodiments and a technical spirit is not limited by the accompanying drawings and all changes, equivalents, or substitutes included in the spirit and the technical scope are included. Meanwhile, the term "disclosure" may be replaced with terms such as document, specification, description, etc.

Figure 2:
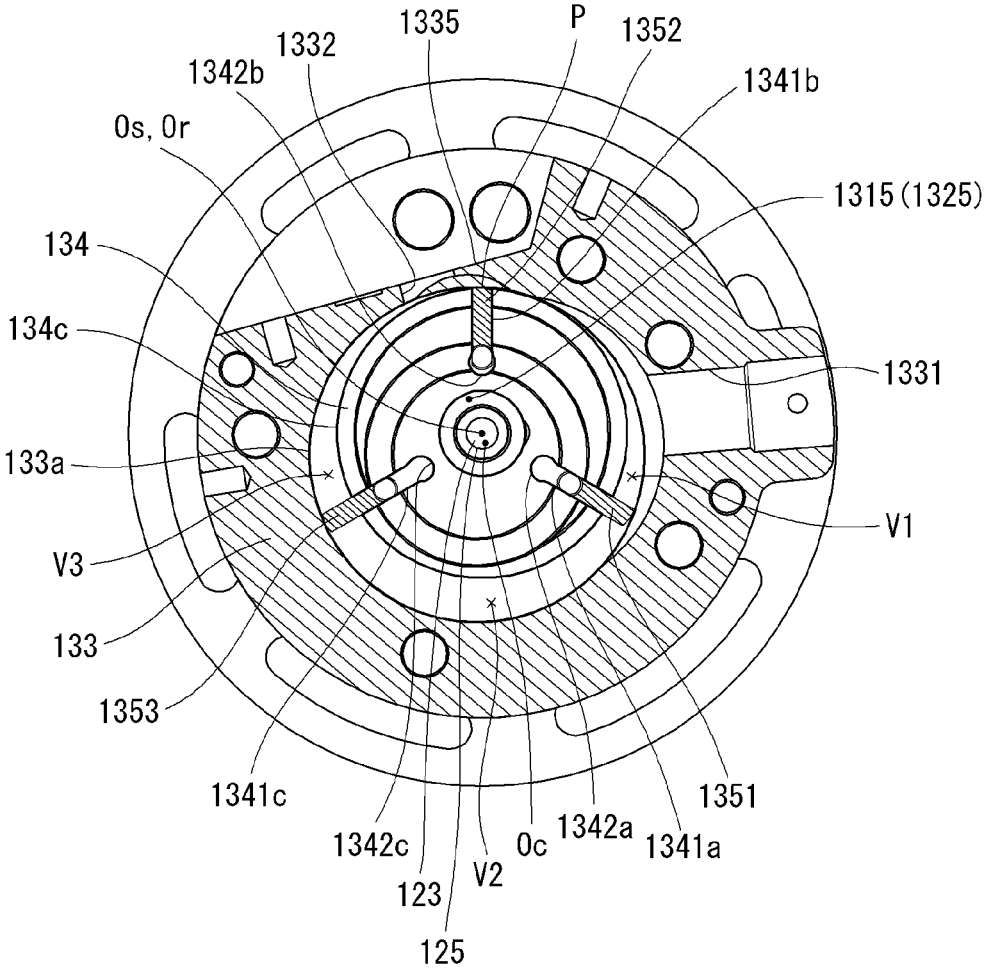
FIG. 2 is a cross-sectional view, taken along line II-II' of FIG. 1.
Figure 3:
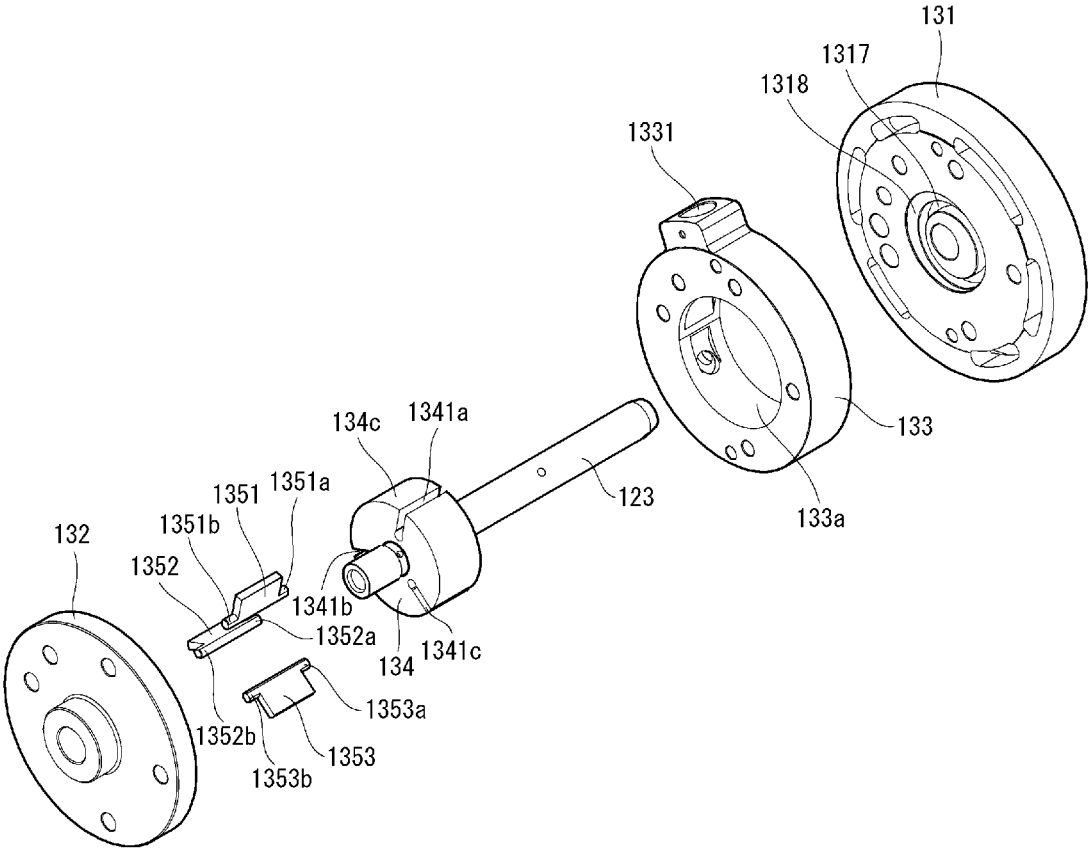
FIGS. 3 and 4 are exploded perspective views of a rotary compressor according to an embodiment.
Figure 4:
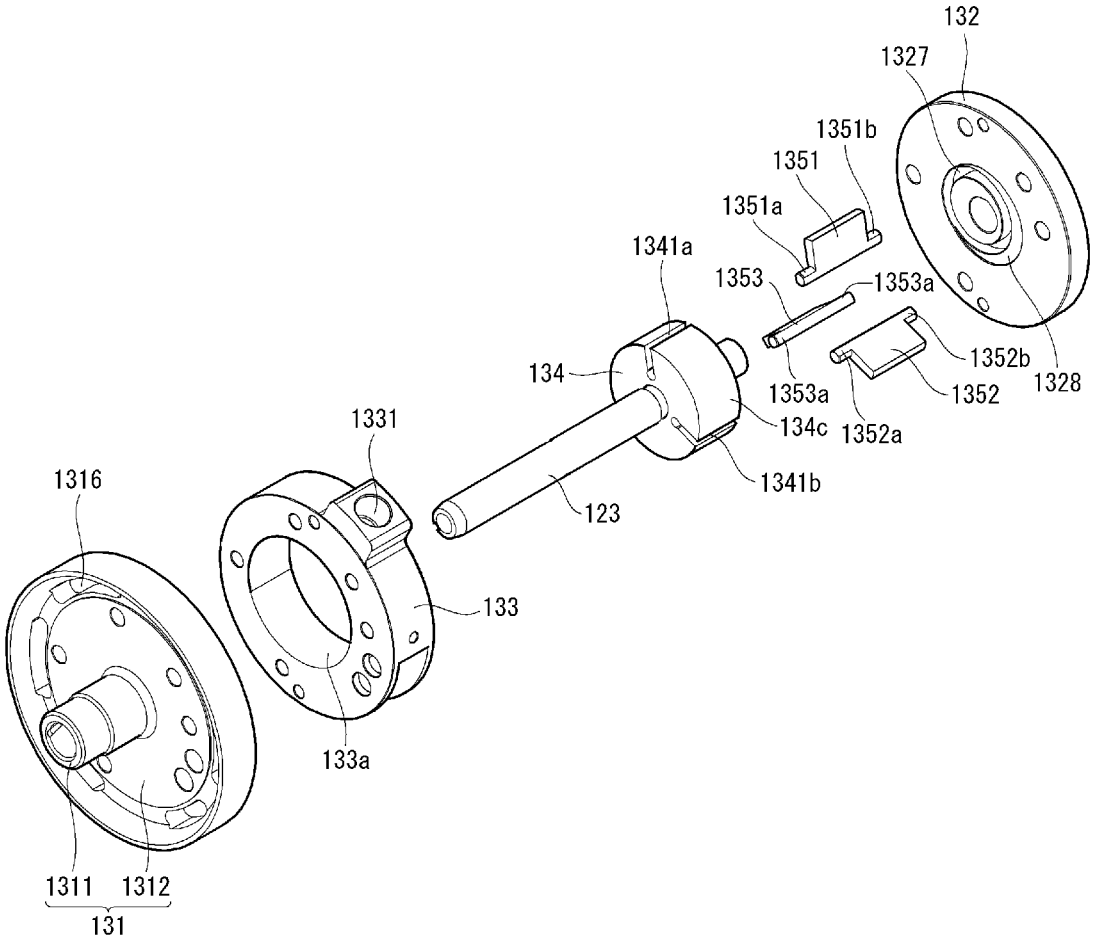
Figure 5:
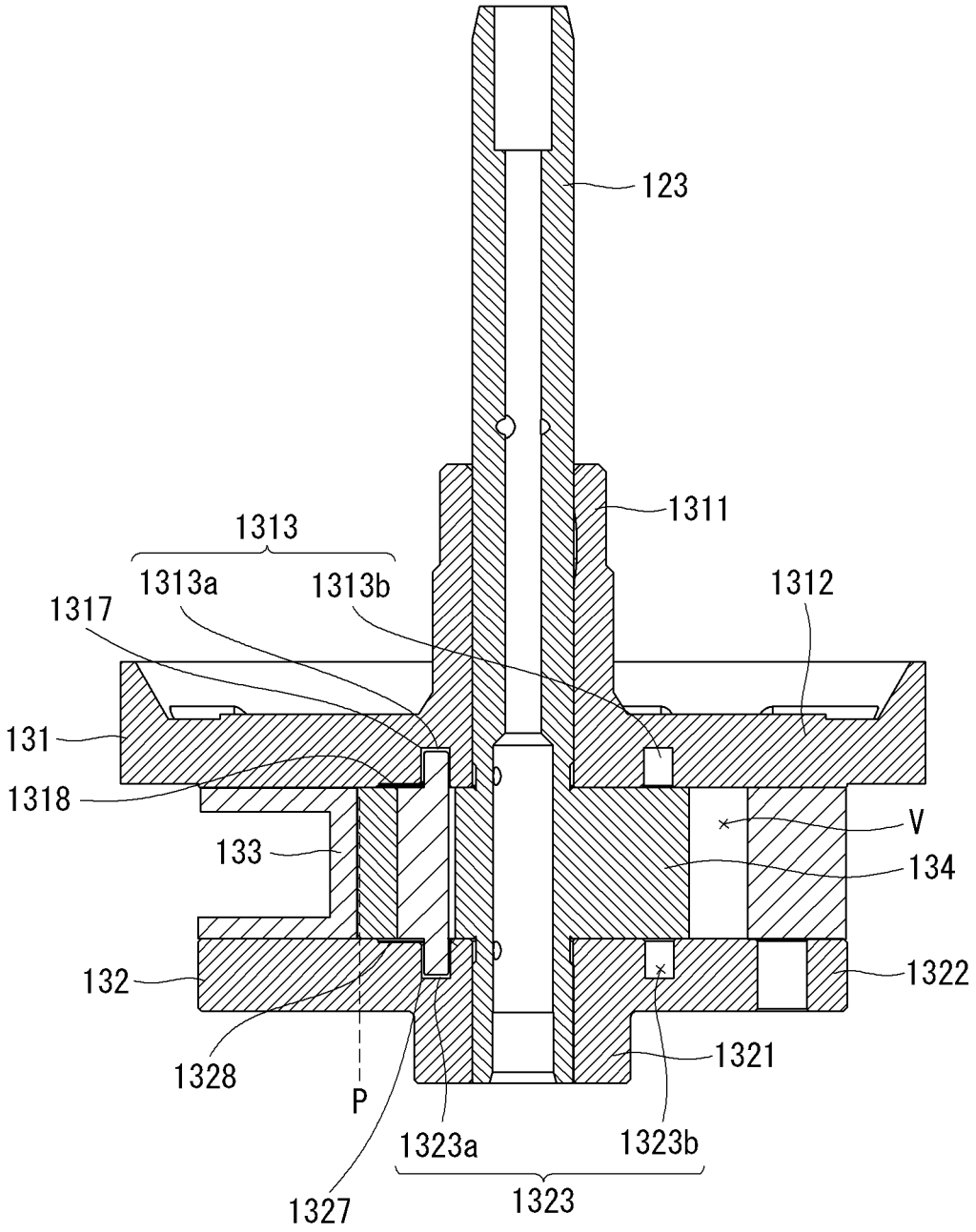
FIG. 5 is a longitudinal cross-sectional view of some components of a rotary compressor according to an embodiment.
Figure 6:
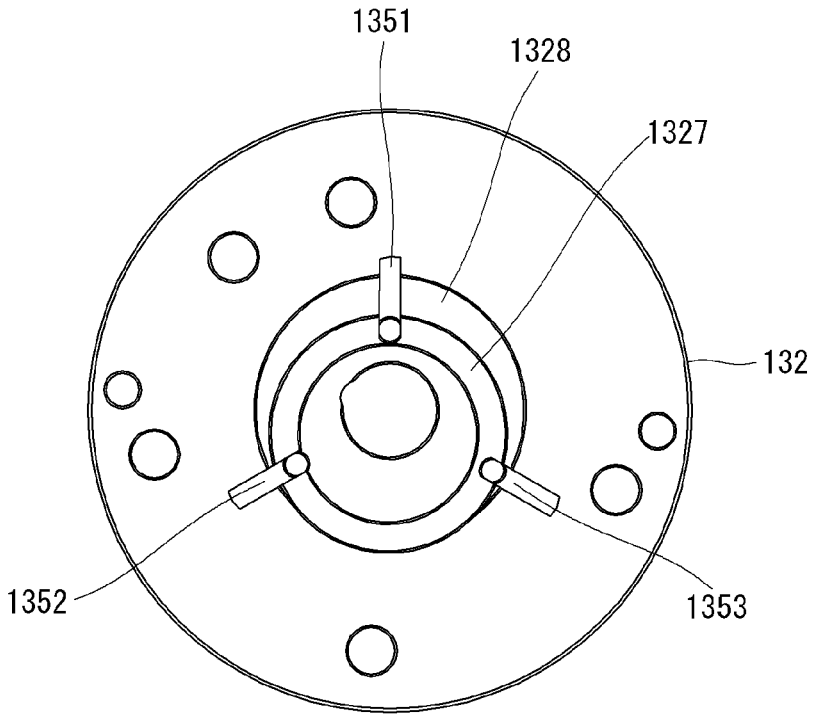
FIG. 6 is a plan view of some components of a rotary compressor according to an embodiment.
Figure 7:
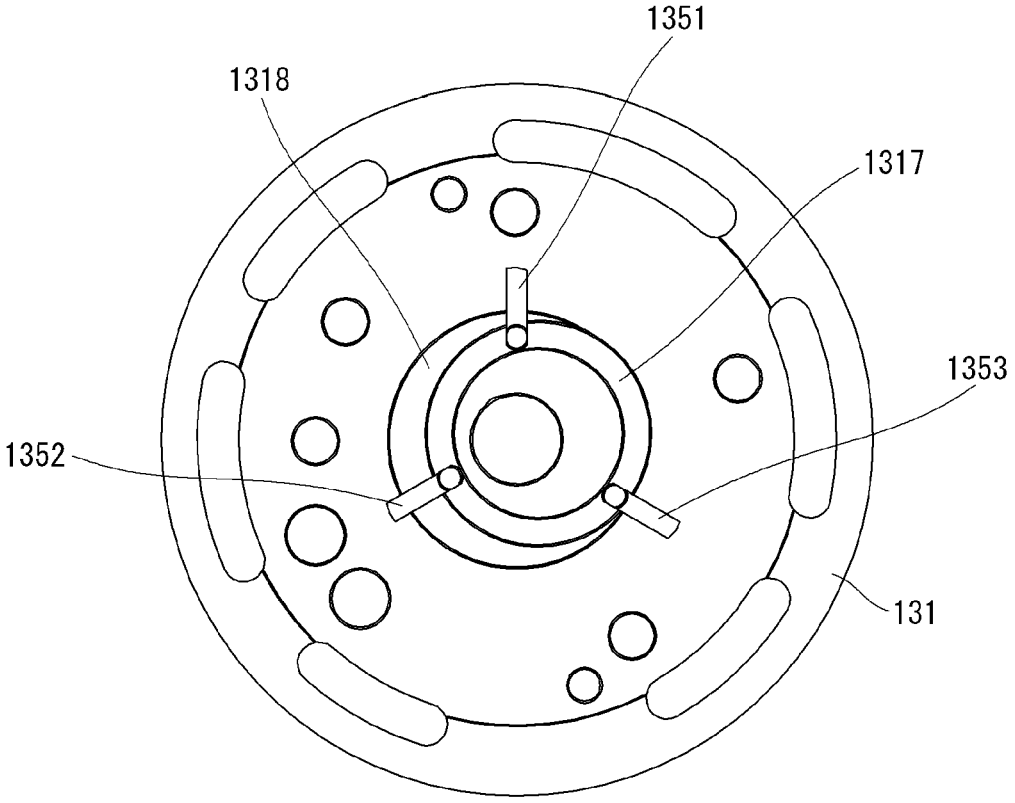
FIG. 7 is a bottom view of some components of a rotary compressor according to an embodiment.
Figure 8:
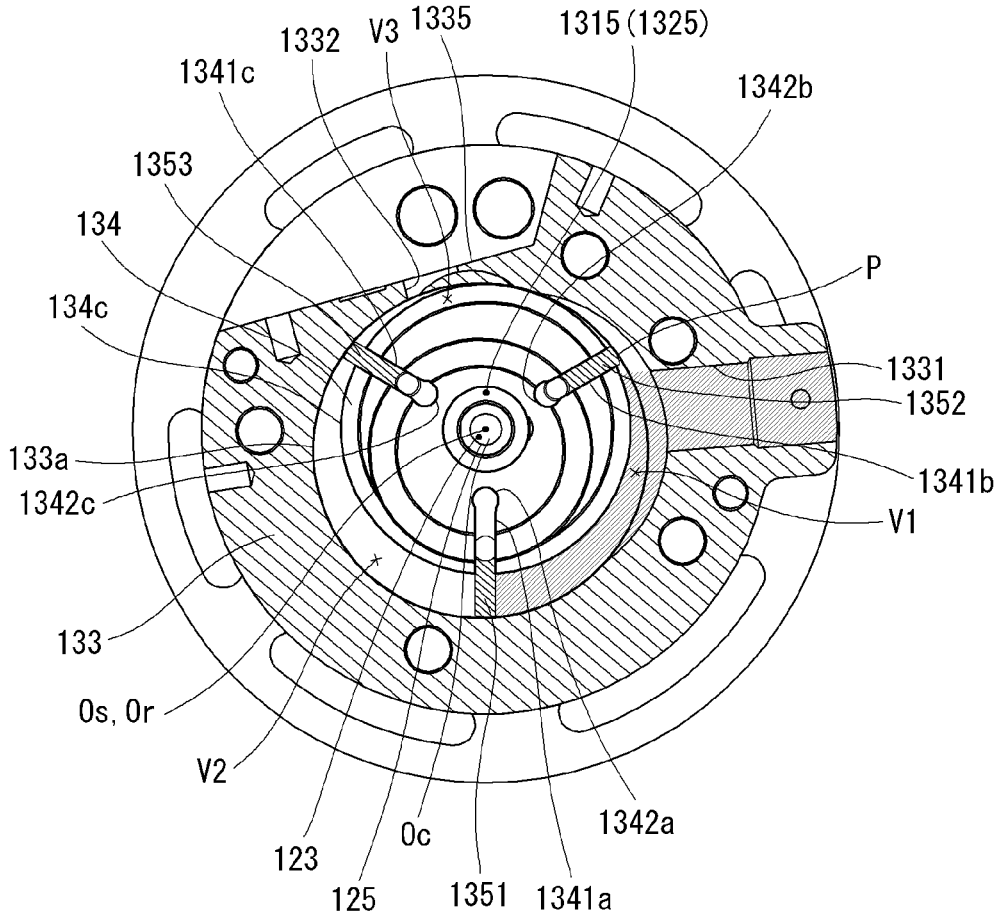
FIGS. 8 to 10 are operation diagrams of a rotary compressor according to an embodiment.
Figure 9:
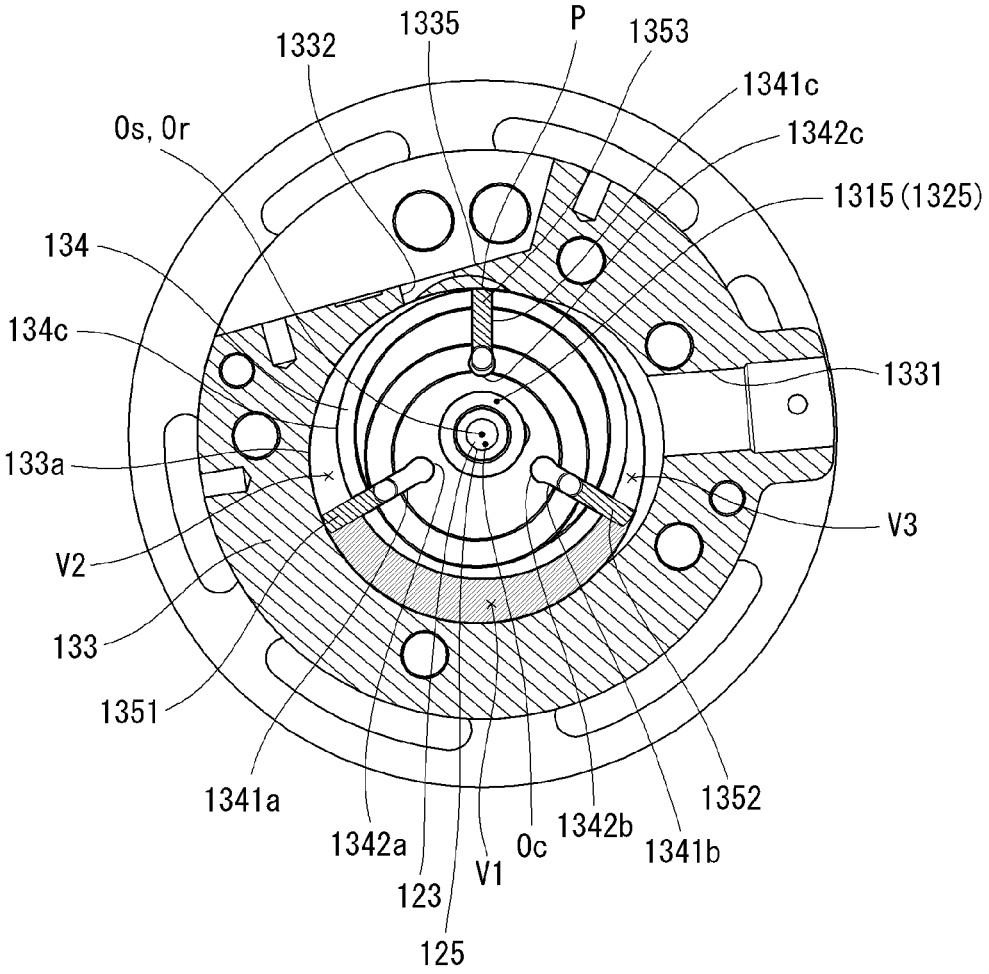
Figure 10:
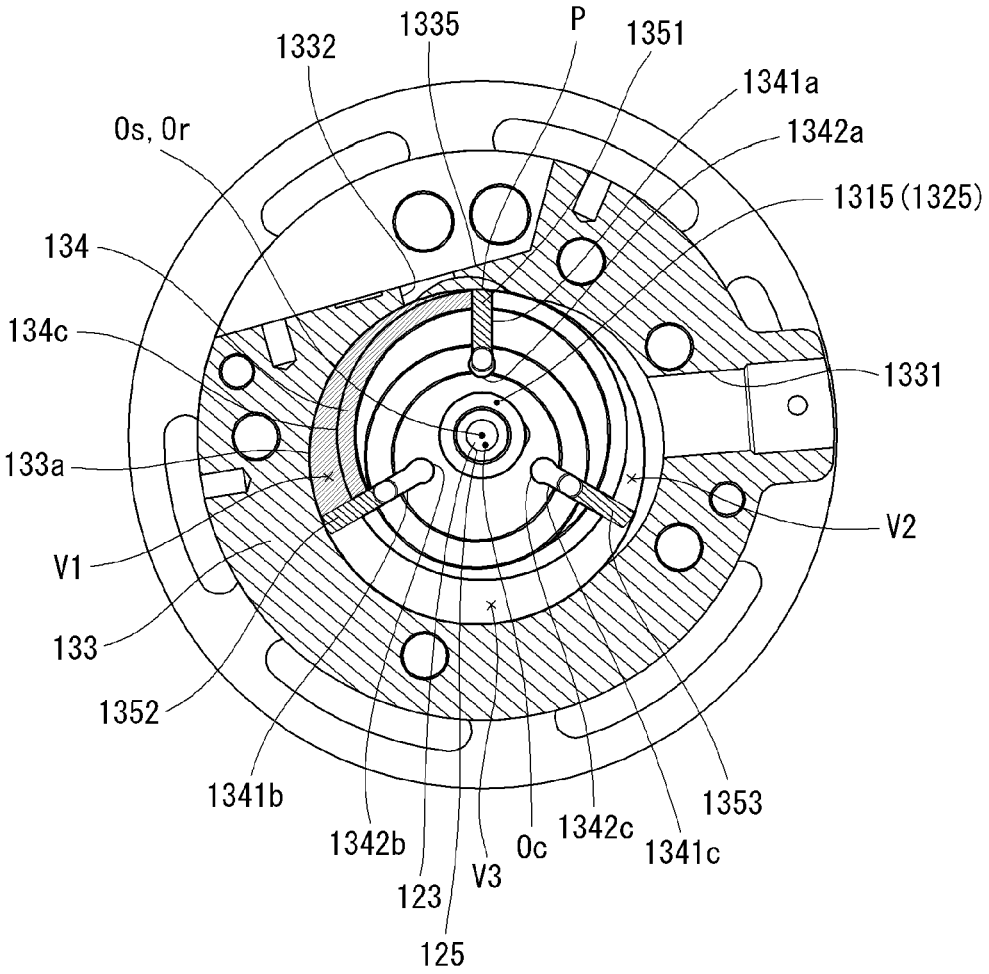
Figure 11:
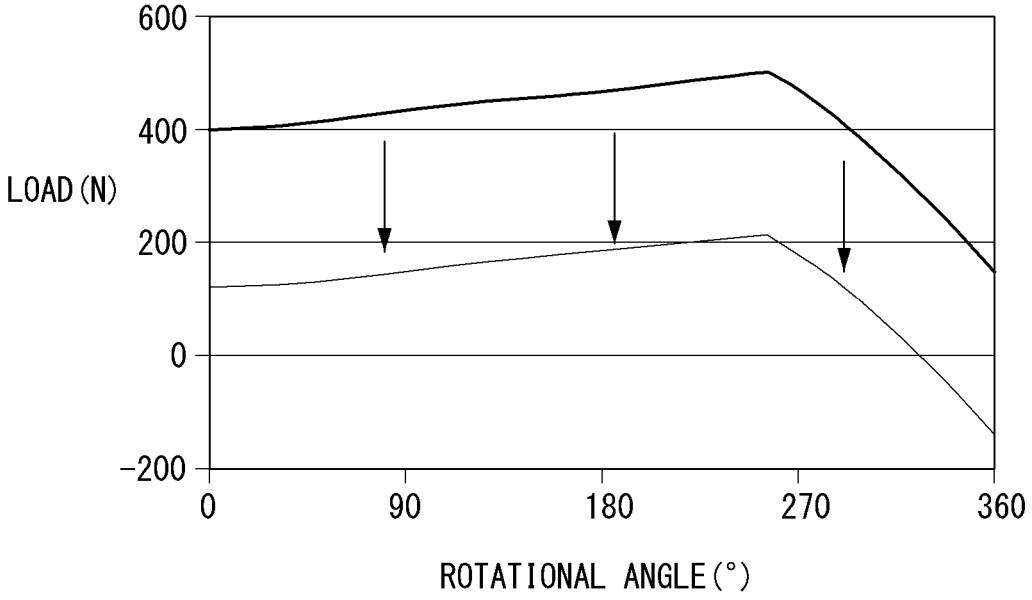
FIG. 11 is a graph showing a load applied to a pin with rotation of a rotary compressor according to an embodiment.

FIG. 1 is a longitudinal cross-sectional view of a rotary compressor according to an embodiment. FIG. 2 is a cross-sectional view, taken along line II-II" of FIG. 1. FIGS. 3 and 4 are exploded perspective views of a rotary compressor according to an embodiment. FIG. 5 is a longitudinal cross-sectional view of some components of a rotary compressor according to an embodiment. FIG. 6 is a plan view of some components of a rotary compressor according to an embodiment. FIG. 7 is a bottom view of some components of a rotary compressor according to an embodiment. FIGS. 8 to 10 are operation diagrams of a rotary compressor according to an embodiment. FIG. 11 is a graph showing a load applied to a pin with rotation of a rotary compressor according to an embodiment.

Referring to FIGS. 1 to 11, a rotary compressor 100 according to an embodiment may include a casing 110, a drive motor 120, and compression units 131, 132, 133, and 134, but other additional components are not excluded. The casing 110 may form an exterior of the rotary compressor 100. The casing 110 may be formed in a cylindrical shape. The casing 110 may be divided into a vertical type or a horizontal type according to an installation mode of the rotary compressor 100. The vertical type may be a structure in which the drive motor 120 and the compression units 131, 132, 133, and 134 are disposed on or at both upper and lower sides in an axial direction and the horizontal type may be a structure in which the drive motor 120 and the compression units 131, 132, 133, and 134 are disposed on or at both left and right or lateral sides. The drive motor 120, a rotational shaft 123, and the compression units 131, 132, 133, and 134 may be disposed in the casing 110. The casing 110 may include an upper shell 110*a*, an intermediate shell 110*b*, and a lower shell 110*c*. The upper shell 110*a*, the intermediate shell 110*b*, and the lower shell 110*c* may seal an inner space S.

The drive motor 120 may be disposed in the casing 110. The drive motor 120 may be disposed inside the casing 110. The compression units 131, 132, 133, and 134 mechanically connected by the rotational shaft 123 may be installed on or at one side of the drive motor 120.

The drive motor 120 may provide power for compressing a refrigerant. The drive motor 120 may include a stator 121, a rotor 122, and the rotational shaft 123.

The stator 121 may be disposed in the casing 110. The stator 121 may be disposed inside the casing 110. The stator 121 may be fixed inside the casing 110. The stator 121 may be mounted on an inner circumferential surface of the cylindrical casing 110 by a method, such as shrink fit, for example. For example, the stator 121 may be fixedly installed on an inner circumferential surface of the intermediate shell 110*b*.

The rotor 122 may be separated from the stator 121. The rotor 122 may be disposed on or at an inner side of the stator 121. The rotational shaft 123 may be disposed at a center of the rotor 122. The rotational shaft 123 may be, for example, press-fit and coupled to the center of the rotor 122.

When power is applied to the stator 121, the rotor 122 may rotate according to an interaction of the stator 121 and the rotor 122. As a result, the rotational shaft 123 coupled to the rotor 122 may rotate concentrically with the rotor 122.

An oil path 125 may be formed at the center of the rotational shaft 123. The oil path 125 may extend in the axial direction. In a middle of the oil path 125, oil through holes 126*a* and 126*b* may be formed through an outer circumferential surface of the rotational shaft 123.

The oil through holes 126*a* and 126*b* may include a first oil through hole 126*a* which belongs to or is formed in a range of a first bearing 1311 and a second oil through hole 126*b* which belongs to or is formed in a range of a second bearing 1321. One first oil through hole 126*a* and one second oil through hole 126*b* may be formed, respectively, or a plurality of each may be formed.

An oil feeder 150 may be disposed in the middle or on or at a bottom of the oil path 125. When the rotational shaft 123 rotates, oil filled in a lower portion of the casing 110 may be pumped by the oil feeder 150. As a result, the oil may rise along the oil path 125, and may be supplied to a sub bearing surface 1321*a* through the second oil through hole 126*b* and supplied to a main bearing surface 1311*a* through the first oil through hole 126*a*.

The first oil through hole 126*a* may be formed to overlap with a first oil groove 1311*b*. The second oil through hole 126*b* may be formed to overlap with a second oil groove 1321*b*. In other words, the oil supplied to the main bearing surface 1311*a* of main bearing 131 and the sub bearing surface 1321*a* of sub bearing 132 through the first oil through hole 126*a* and the second oil through hole 126*b* may rapidly flow into a main-side second pocket 1313*b* and a sub-side second pocket 1323*b*.

The compression units 131, 132, 133, and 134 may include main bearing 131 installed on or at both sides in the axial direction, a cylinder 133 in which compression space 410 is formed by the sub bearing 132, and a rotor 134 rotatably disposed inside the cylinder 133.

Referring to FIGS. 1 and 2, the main bearing 131 and the sub bearing 132 may be disposed in the casing 110. The main bearing 131 and the sub bearing 132 may be fixed to the casing 110. The main bearing 131 and the sub bearing 132 may be separated from each other along the rotational shaft 123. The main bearing 131 and the sub bearing 132 may be separated from each other in the axial direction. In one embodiment, the axial direction may mean a vertical direction based on FIG. 1.

The main bearing 131 and the sub bearing 132 may support the rotational shaft 123 in a radial direction. The main bearing 131 and the sub bearing 132 may support the cylinder 133 and the rotor 134 in the axial direction. The main bearing 131 and the sub bearing 132 may include bearings 1311 and 1321 that support the rotational shaft 123 in the radial direction and flanges 1312 and 1322 that extend on or from the bearings 1311 and 1321 in the radial direction. More specifically, the main bearing 131 may include first bearing 1311 that supports the rotational shaft 123 in the radial direction and first flange 1312 that extends on or from the first bearing 1311 in the radial direction and the sub bearing 132 may include second bearing 1321 that supports the rotational shaft 123 in the radial direction and second flange 1322 that extends on or from the second bearing 1321 in the radial direction.

Each of the first bearing 1311 and the second bearing 1321 may be formed in a bush shape. The first flange 1312 and the second flange 1322 may be formed in a disc shape. The first oil groove 1311*b* may be formed on the main bearing surface 1311*a* which is a radial inner circumferential surface of the first bearing 1311. The second oil groove 1321*b* may be formed on the sub bearing surface 1321*a* which is a radial inner circumferential surface of the second bearing 1321. The first oil groove 1311*b* may be formed as a straight line or a diagonal line between upper and lower ends of the first bearing 1311. The second oil groove 1321*b* may be formed as a straight line or a diagonal line between the upper and lower ends of the second bearing 1321.

A first communication path 1315 may be formed in the first oil groove 1311*b*. A second communication path 1325 may be formed in the second oil groove 1321*b*. The first communication path 1315 and the second communication path 1325 may guide the oil which flows to the main bearing surface 1311*a* and the sub bearing surface 1321*a* to a main-side back pressure pocket 1313 and a sub-side back pressure pocket 1323.

The main-side back pressure pocket 1313 may be formed in the first flange 1312. The sub-side back pressure pocket 1323 may be formed in the second flange 1322. The main-side back pressure pocket 1313 may include main-side first pocket 1313*a* and main-side second pocket 1313*b*. The sub-side back pressure pocket 1323 may include sub-side first pocket 1323*a* and sub-side second pocket 1323*b*.

The main-side first pocket 1313*a* and the main-side second pocket 1313*b* may be formed at a predetermined interval in a circumferential direction. The sub-side first pocket 1323*a* and the sub-side second pocket 1323*b* may be formed at a predetermined interval in the circumferential direction.

The main-side first pocket 1313*a* may form a lower pressure than the main-side second pocket 1313*b*, for example, an intermediate pressure between a suction pressure and a discharge pressure. The sub-side first pocket 1323*a* may form a lower pressure than the sub-side second pocket 1323*b*, for example, an intermediate pressure between the suction pressure and the discharge pressure. The pressure of the main-side first pocket 1313*a* and the pressure of the sub-side first pocket 1323*a* may correspond to each other.

While the oil flows into the main-side first pocket 1313*a* through a minute passage between a main-side first bearing protrusion 1314*a* and a top 134*a* of the rotor 134, the main-side first pocket 1313*a* is depressurized, and as a result, the intermediate pressure may be formed. While the oil flows into the sub-side first pocket 1323*a* through a minute passage between a sub-side first bearing protrusion 1324*a* and a bottom 134*b* of the rotor 134, the sub-side first pocket 1323*a* is depressurized, and as a result, the intermediate pressure may be formed.

As the oil which flows to the main bearing surface 1311*a* through the first oil through hole 126*a* flows into the main-side second pocket 1313*b* through the first communication path 1315, the main-side second pocket 1313*b* may be maintained at the discharge pressure or at a pressure similar to the discharge pressure. As the oil which flows to the sub bearing surface 1321*a* through the second oil through hole 126*b* flows into the sub-side second pocket 1323*b* through the second communication path 1325, the sub-side second pocket 1323*b* may be maintained at a discharge pressure or at a pressure similar to the discharge pressure.

In the cylinder 133, an inner circumferential surface forming the compression space 410 may be formed in a circular shape. In contrast, the inner circumferential surface of the cylinder 133 may be formed in a symmetrical elliptical shape having a pair of long axis and short axis or an asymmetrical elliptical shape having several pairs of long axes and short axes. An outer circumferential surface of the cylinder 133 may be formed in the circular shape, but if the outer circumferential surface of the cylinder 133 may be fixed to the inner circumferential surface of the casing 110, the outer circumferential surface of the cylinder 133 is not limited thereto and may be variously changed. The cylinder 133 may be fastened to the main bearing 131 or the sub bearing 132 fixed to the casing 110 with a bolt, for example.

An empty space may be formed at a center of the cylinder 133 so as to form the compression space 410 including the inner circumferential surface. The empty space may be sealed by the main bearing 131 and the sub bearing 132 to form the compression space 410. The rotor 134, the outer circumferential surface of which may be formed in the circular shape, may be rotatably disposed in the compression space 410.

An inlet 1331 and an outlet 1332 may be formed at both circumferential sides around a contact point P where inner circumferential surface 133*a* of the cylinder 133 and outer circumferential surface 134*c* of the rotor 134 are almost in contact with each other on the inner circumferential surface 133*a* of the cylinder 133. The inlet 1331 and the outlet 1332 may be separated from each other. In other words, the inlet 1331 may be formed at a front flow side based on a compression path (a rotational direction) and the outlet 1332 may be formed at a rear flow side in a direction in which the refrigerant is compressed.

A suction pipe 113 that penetrates the casing 110 may be directly connected to the inlet 1331. The outlet 1332 may be indirectly connected to a discharge pipe 114 which communicates with internal space S of the casing 110 and is through-coupled to the casing 110. As a result, the refrigerant may be directly suctioned into the compression space 410 through the inlet 1331 and the compressed refrigerant may be discharged to the internal space S of the casing 110 through the outlet 1332 and then discharged to the discharge pipe 114. Accordingly, the internal space S of the casing 110 may be maintained at a high-pressure state having the discharge pressure.

More specifically, high-pressure refrigerant discharged from the outlet 1332 may stay in the internal space S adjacent to the compression units 131, 132, 133, and 134. As the main bearing 131 is fixed to the inner circumferential surface of the casing 110, the main bearing 131 may border upper and lower sides of the internal space S. In this case, the high-pressure refrigerant which stays in the internal space S may rise through discharge path 1316 and may be discharged to the outside through the discharge pipe 114 provided at an upper side of the casing 110.

The discharge path 1316 may penetrate the first flange 1312 of the main bearing 131 in the axial direction. The discharge path 1316 may secure a sufficient path area so as to prevent path resistance from being generated. More specifically, the discharge path 1316 may be formed to extend in the circumferential direction in a region which does not overlap with the cylinder 133 in the axial direction. In other words, the discharge path 1316 may be formed to have an arc shape.

Further, the discharge path 1316 may be constituted by a plurality of holes separated from each other in the circumferential direction. As such, as a maximum path area is secured, the path resistance may be reduced when the high-pressure refrigerant moves to the discharge pipe 114 provided at the upper side of the casing 110.

Further, a separate suction valve is not installed in the inlet 1331, while a discharge valve 1335 that opens and closes the outlet 1332 may be disposed in the outlet 1332. The discharge valve 1335 may include a lead type valve one end of which is fixed and the other end of which is a free end. Alternatively, the discharge valve 1335 may be variously changed as necessary, and may be a piston valve, for another example.

When the discharge valve 1335 is formed by the lead type valve, a discharge groove (not illustrated) may be formed on the outer circumferential surface of the cylinder 133 so that the discharge valve 1335 may be mounted. As a result, a length of the outlet 1332 may be reduced to a minimum, thereby reducing a dead volume. At least a portion of a valve groove may be formed in a triangular shape so as to secure a flat valve seat surface as illustrated in FIG. 2. In one embodiment, it is described as an example that one outlet 1332 is provided; however, embodiments are not limited thereto and a plurality of the outlet 1332 may be provided along a compression path (compression progress direction).

The rotor 134 may be disposed in the cylinder 133. The rotor 134 may be disposed in the compression space 410 of the cylinder 133. The outer circumferential surface 134*c* of the rotor 134 may be formed in a circular shape. The rotational shaft 134 may be disposed at a center of the rotor 123. The rotational shaft 123 may be integrally coupled to the center of the rotor 134. Therefore, the rotor 134 may have a center Or which coincides with a shaft center Os of the rotational shaft 123 and may rotate concentrically with the rotational shaft 123 around the center Or of the rotor 134.

The center Or of the rotor 134 may be eccentric with respect to a center Oc of the cylinder 133, that is, the center Oc of an internal space of the cylinder 133. One side of the outer circumferential surface 134*c* of the rotor 134 may be almost in contact with the inner circumferential surface 133*a* of the cylinder 133. The outer circumferential surface 134*c* of the rotor 134 is not actually in contact with the inner circumferential surface 133*a* of the cylinder 133, but the outer circumferential surface 134*c* of the rotor 134 and the inner circumferential surface 133*a* of the cylinder 133 are separated from each other and should be adjacent to each other enough to limit leakage of the high-pressure refrigerant in a discharge pressure region to a suction pressure region through a gap between the outer circumferential surface 134*c* of the rotor 134 and the inner circumferential surface 133*a* of the cylinder 133 without occurrence of friction damage. A point of the cylinder 133 almost contacting one side of the rotor 134 may be regarded as contact point P.

At least one vane slot 1341*a*, 1341*b*, or 1341*c* may be formed at an appropriate location in the circumferential direction of the outer circumferential surface 134*c* of the rotor 134. The vane slots 1341*a*, 1341*b*, and 1341*c* may include a first vane slot 1341*a*, a second vane slot 1341*b*, and a third vane slot 1341*c*. In one embodiment, it is described as an example that three vane slots 1341*a*, 1341*b*, and 1341*c* are formed; however, embodiments are not limited thereto and the vane slots may be variously changed according to the number of vanes 1351, 1352, and 1353.

First to third vanes 1351, 1352, and 1353 may be slidably coupled to the first to third vane slots 1341*a*, 1341*b*, and 1341*c*, respectively. Each of the first to third vane slots 1341*a*, 1341*b*, and 1341*c* may be formed toward the radial direction based on the center Or of the rotor 134. In other words, each of straight lines extending from the first to third vane slots 1341*a*, 1341*b*, and 1341*c*, respectively, may pass through the center Or of the rotor 134.

First to third back pressure chambers 1342*a*, 1342*b*, and 1342*c* may be formed on inner ends of the first to third vane slots 1341*a*, 1341*b*, and 1341*c*, respectively, in which each of the first to third vanes 1351, 1352, and 1353 allows the oil or refrigerant to flow into a rear side to add each of the first to third vanes 1351, 1352, and 1353 in the inner circumferential surface of the cylinder 133. The first to third back pressure chambers 1342*a*, 1342*b*, and 1342*c* may be sealed by the main bearing 131 and the sub bearing 132. Each of the first to third back pressure chambers 1342*a*, 1342*b*, and 1342*c* may independently communicate with back pressure pockets 1313 and 1323. Alternatively, the first to third back pressure chambers 1342*a*, 1342*b*, and 1342*c* may communicate with each other by the back pressure pockets 1313 and 1323.

The back pressure pockets 1313 and 1323 may be formed in the main bearing 131 and the sub bearing 132, respectively, as illustrated in FIG. 1. Alternatively, the back pressure pockets 1313 and 1323 may be formed only on either the main bearing 131 or the sub bearing 132. In one embodiment, it is described as an example that the back pressure pockets 1313 and 1323 are formed in both the main bearing 131 and the sub bearing 132. The back pressure pockets 1313 and 1323 may include main-side back pressure pocket 1313 formed in the main bearing 131 and sub-side back pressure pocket 1323 formed in the sub bearing 132.

The main-side back pressure pocket 1313 may include main-side first pocket 1313*a* and main-side second pocket 1313*b*. The main-side second pocket 1313*b* may have a higher pressure than the main-side first pocket 1313*a*. The sub-side back pressure pocket 1323 may include sub-side first pocket 1323*a* and sub-side second pocket 1323*b*. The sub-side second pocket 1323*b* may have a higher pressure than the sub-side first pocket 1323*a*. Therefore, the main-side first pocket 1313*a* and the sub-side first pocket 1323*a* may communicate with a vane chamber to which a vane located relatively upstream (before a discharge stroke in a suction stroke) among the vanes 1351, 1352, and 1353 belongs and the main-side second pocket 1313*b* and the sub-side second pocket 1323*b* may communicate with a vane chamber to which a vane located relatively downstream (before the suction stroke in the discharge stroke) belongs among the vanes 1351, 1352, and 1353.

Among the first to third vanes 1351, 1352, and 1353, a vane closest to the contact point P based on a compression progress direction may be referred to as "first vane 1351" and subsequent vanes may be sequentially referred to as "second vane 1352" and "third vane 1353". In this case, there may be a spacing as large as a same circumferential angle between the first vane 1351 and the second vane 1352, between the second vane 1352 and the third vane 1353, and between the third vane 1353 and the first vane 1351.

When a compression chamber formed by the first vane 1351 and the second vane 1352 is referred to as a "first compression chamber V1", a compression chamber formed by the second vane 1352 and the third vane 1353 is referred to as a "second compression chamber V2", and a compression chamber constituted by the third vane 1353 and the first vane 1351 is referred to as a "third compression chamber V3", all the compression chambers V1, V2, and V3 have a same volume at a same crank angle. The first compression chamber V1 may be referred to as a "suction chamber" and the third compression chamber V3 may be referred to as a "discharge chamber".

Each of the first to third vanes 1351, 1352, and 1353 may be formed in a substantially rectangular parallelepiped shape. A surface among both longitudinal ends of each of the first to third vanes 1351, 1352, and 1353, which is in contact with the inner circumferential surface 133*a* of the cylinder 133, may be referred to as a "front end surface" and a surface facing each of the first to third back pressure chambers 1342*a*, 1342*b*, and 1342*c* may be referred to as a "rear end surface".

The front end surface of each of the first to third vanes 1351, 1352, and 1353 may be formed in a curved surface shape so as to be in line contact with the inner circumferential surface 133*a* of the cylinder 133. The rear end surfaces of the first to third vanes 1351, 1352, and 1353 may be inserted into the first to third back pressure chambers 1342*a*, 1342*b*, and 1342*c*, respectively, to be formed flat to evenly receive a back pressure.

In the rotary compressor 100, when power is applied to the drive motor 120 and the rotor 122 and the rotational shaft 123 rotate, the rotor 134 rotates together with the rotational shaft 123. In this case, the first to third vanes 1351, 1352, and 1353 may be drawn out from the first to third vane slots 1341*a*, 1341*b*, and 1341*c*, respectively, by a centrifugal force generated by rotation of the rotor 134 and the respective back pressures of the first to third back pressure chambers 1342*a*, 1342*b*, and 1342*c* disposed at rear sides of the first to third back pressure chambers 1342*a*, 1342*b*, and 1342*c*, respectively. Therefore, the front end surface of each of the first to third vanes 1351, 1352, and 1353 is in contact with the inner circumferential surface 133*a* of the cylinder 133.

In one embodiment, a case in which the front end surface of each of the first to third vanes 1351, 1352, and 1353 is in contact with the inner circumferential surface 133*a* of the cylinder 133 may mean that the front end surface of each of the first to third vanes 1351, 1352, and 1353 is in direct contact with the inner circumferential surface 133*a* of the cylinder 133 and that the front end surface of each of the first to third vanes 1351, 1352, and 1353 is adjacent to the inner circumferential surface 133*a* of the cylinder 133 enough to be in direct contact with the inner circumferential surface 133*a* of the cylinder 133. The compression space 410 of the cylinder 133 may form compression chambers V1, V2, and V3 (including the suction chamber and the discharge chamber) by the first to third vanes 1351, 1352, and 1353 and while each of the compression chambers V1, V2, and V3 moves with the rotation of the rotor 134, a volume of each of the compression chambers V1, V2, and V3 may be varied by eccentricity of the rotor 134. Therefore, refrigerant filled in each of the compression chambers V1, V2, and V3 may be suctioned, compressed, and discharged while moving along the rotor 134 and the vanes 1351, 1352, and 1353.

The first to third vanes 1351, 1352, and 1353 may include upper pins 1351*a*, 1352*a*, and 1353*a* and lower pins 1351*b*, 1352*b*, and 1353*b*, respectively. The upper pins 1351*a*, 1352*a*, and 1353*a* may include a first upper pin 1351*a* formed on a top of the first vane 1351, a second upper pin 1352*a* formed on a top of the second vane 1352, and a third upper pin 1353*a* formed on a top of the third vane 1353. The lower pins 1351*b*, 1352*b*, and 1353*b* may include a first lower pin 1351*b* formed on a bottom of the first vane 1351, a second lower pin 1352*b* formed on a bottom of the second vane 1352, and a third lower pin 1353*b* formed on a bottom of the third vane 1353.

The bottom of the main bearing 131 may include a first rail groove 1317 into which the upper pins 1351*a*, 1352*a*, and 1353*a* may be inserted. The first rail groove 1317 may be formed in a circular band shape. The first rail groove 1317 may be disposed adjacent to the rotational shaft 123. As the first to third upper pins 1351*a*, 1352*a*, and 1353*a* of the respective first to third vanes 1351, 1352, and 1353 are inserted into the first rail groove 1317 to guide positions of the first to third vanes 1351, 1352, and 1353, compression efficiency may be enhanced by preventing direct contact between the vanes 1351, 1352, and 1353 and the cylinder 133 and deterioration in reliability by abrasion of a product may be prevented.

The bottom of the main bearing 131 may include a first step portion or step 1318 disposed adjacent to the first rail groove 1317. The first step portion 1318 may be disposed between the bottom of the main bearing 131 and the first rail groove 1317. An outermost side of the first step portion 1318 may be disposed inside an outer surface of the rotor 134. An innermost side of the first step portion 1318 may be disposed outside the rotational shaft 123. Therefore, the first step portion 1318 may reduce the pressure of the compression space 410 by increasing an area of the compression space 410 to reduce a load applied to the first to third upper pins 1351*a*, 1352*a*, and 1353*a*, thereby preventing damage to the component.

Further, the first step portion 1318 may be disposed adjacent to the inlet 1331. Further, a width of the first step portion 1318 may become larger or increase as the first step portion 1318 is closer to the inlet 1331. More specifically, referring to FIGS. 3, 4, 6, and 7, a cross section of the first step portion 1318 may be formed in a half moon shape, the first step portion 1318 may be disposed closer to the inlet 1331 than to the outlet 1332, and the width of the first step portion 1318 may become larger or increase as the first step portion 1318 is closer to the inlet 1331. Therefore, efficiency of reducing the load applied to the first to third upper pins 1351*a*, 1352*a*, and 1353*a* may be enhanced.

The top of the sub bearing 132 may include a second rail groove 1327 into which the lower pins 1351*b*, 1352*b*, and 1353*b* may be inserted. The second rail groove 1327 may be formed in a circular band shape. The second rail groove 1327 may be disposed adjacent to the rotational shaft 123. As the first to third lower pins 1351*b*, 1352*b*, and 1353*b* of the respective first to third vanes 1351, 1352, and 1353 are inserted into the second rail groove 1327 to guide positions of the first to third vanes 1351, 1352, and 1353, the compression efficiency may be enhanced by preventing direct contact between the vanes 1351, 1352, and 1353 and the cylinder 133 and deterioration in reliability by the abrasion of the product may be prevented.

The first rail groove 1317 and the second rail groove 1327 may be formed in shapes corresponding to each other. The first rail groove 1317 and the second rail groove 1327 may overlap with each other in the axial direction. Therefore, efficiency of guiding the positions of the first to third vanes 1351, 1352, and 1353 may be enhanced.

The sub bearing 132 may include a second step portion or step 1328 disposed adjacent to the second rail groove 1327. The second step portion 1328 may be disposed between the top of the sub bearing 132 and the second rail groove 1327. An outermost side of the second step portion 1328 may be disposed inside the outer surface of the rotor 134. An innermost side of the second step portion 1328 may be disposed outside the rotational shaft 123. Therefore, the second step portion 1328 may reduce the pressure of the compression space 410 by increasing the area of the compression space 410 to reduce a load applied to the first to third lower pins 1351*b*, 1352*b*, and 1353*b*, thereby preventing damage to components.

Further, the second step portion 1328 may be disposed adjacent to the inlet 1331. A width of the second step portion 1328 may become larger or increase as the second step portion 1328 is closer to the inlet 1331. More specifically, referring to FIGS. 3, 4, 6, and 7, a cross section of the second step portion 1328 may be formed in a half moon shape, the second step portion 1328 may be disposed closer to the inlet 1331 than to the outlet 1332, and a width of the second step portion 1328 may become larger or increase as the second step portion 1328 is closer to the inlet 1331. Therefore, efficiency of reducing the load applied to the first to third lower pins 1351*b*, 1352*b*, and 1353*b* may be enhanced.

The first step portion 1318 and the second step portion 1328 may be formed in shapes corresponding to each other. The first step portion 1318 and the second step portion 1328 may overlap with each other in the axial direction. Therefore, the efficiency of reducing the load applied to the first to third lower pins 1351*b*, 1352*b*, and 1353*b* may be enhanced.

In one embodiment, it is described as an example that each of the number of vanes 1351, 1352, and 1353, the number of vane slots 1341*a*, 1341*b*, and 1341*c*, and the number of back pressure chambers 1342*a*, 1342*b*, and 1342*c* is three, but each of the number of vanes 1351, 1352, and 1353, the number of vane slots 1341*a*, 1341*b*, and 1341*c*, and the number of back pressure chambers 1342*a*, 1342*b*, and 1342*c* may be variously changed.

Further, in one embodiment, it is described as an example that the upper pins 1351*a*, 1352*a*, and 1353*a* and the lower pins 1351*b*, 1352*b*, and 1353*b* are all formed on the vanes 1351, 1352, and 1353; however, only the upper pins 1351*a*, 1352*a*, and 1353*a* may be formed or only the lower pins 1351*b*, 1352*b*, and 1353*b* may be formed.

A process in which refrigerant is suctioned, compressed, and discharged in the cylinder 133 according to an embodiment will be described with reference to FIGS. 8 to 10.

Referring to FIG. 8, until the first vane 1351 passes through the inlet 1331 and the second vane 1352 reaches a suction completion time, the volume of the first compression chamber V1 continuously increases. In this case, the refrigerant may continuously flow into the first compression chamber V1 from the inlet 1331.

The first back pressure chamber 1342*a* disposed at a rear side of the first vane 1351 may be exposed to each of the main-side first pocket 1313*a* of the main-side back pressure pocket 1313 and the main-side second pocket 1313*b* of the main-side back pressure pocket 1313 disposed at a rear side of the second vane 1352. As a result, the intermediate pressure may be formed in the first back pressure chamber 1342*a* and the first vane 1351 may be pressurized by the intermediate pressure to be in close contact with the inner circumferential surface 133*a* of the cylinder 133 and a discharge pressure or a pressure close to the discharge pressure is formed in the second back pressure chamber 1342*b* and the second vane 1352 may be pressurized by the discharge pressure to be in close contact with the inner circumferential surface 133*a* of the cylinder 133.

Referring to FIG. 9, when the second vane 1352 performs the compression stroke after the suction completion time (or compression start time), the first compression chamber V1 becomes a sealing state to move toward the outlet together with the rotor 134. In such a process, the volume of the first compression chamber V1 may continuously decrease and the refrigerant of the first compression chamber V1 may be gradually compressed.

Referring to FIG. 10, when the first vane 1351 passes through the outlet 1332 and the second vane 1352 does not reach the outlet 1332, the discharge valve 1335 may be opened by the pressure of the first compression chamber V1 while the first compression chamber V1 communicates with the outlet 1332. In this case, refrigerant of the first compression chamber V1 may be discharged to an internal space of the casing 110 through the outlet 1332.

In this case, the first back pressure chamber 1342*a* of the first vane 1351 may be just before entering the main-side first pocket 1313*a*, which is an intermediate pressure region, by passing through the main-side second pocket 1313*b*, which is the discharge pressure region. Accordingly, the back pressured formed in the first back pressure chamber 1342*a* of the first vane 1351 may be lowered from the discharge pressure to the intermediate pressure. In contrast, the second back pressure chamber 1342*b* of the second vane 1352 may be located in the main-side second pocket 1313*b*, which is the discharge pressure region, and the back pressure corresponding to the discharge pressure may be formed in the second back pressure chamber 1342*b*.

As a result, the intermediate pressure between the suction pressure and the discharge pressure may be formed on a rear end portion of the first vane 1351 located in the main-side first pocket 1313*a* and the discharge pressure (actually, a pressure slightly lower than the discharge pressure) may be formed on the rear end portion of the second vane 1352 located in the main-side second pocket 1313*b*. In particular, as the main-side second pocket 1313*b* is in direct communication with the oil path 125 through the first oil through hole 126*a* and the first communication path 1315, the pressure of the second back pressure chamber 1342*b* which communicates with the main-side second pocket 1313*b* may be prevented from increasing to the discharge pressure or more. As a result, the intermediate pressure lower than the discharge pressure is formed in the main-side first pocket 1313*a* to increase mechanical efficiency between the cylinder 133 and the vanes 1351, 1352, and 1353. Further, as the discharge pressure or the pressure slightly lower than the discharge pressure is formed in the main-side second pocket 1313*b*, the vanes 1351, 1352, and 1353 are disposed adjacent to the cylinder 133 to increase mechanical efficiency while suppressing leakage between the compression chambers.

Referring to FIG. 11, it can be seen that the pressure applied to the upper pins 1351*a*, 1352*a*, and 1353*a* and/or the lower pins 1351*b*, 1352*b*, and 1353*b* of the vanes 1351, 1352, and 1353 is lowered in the rotary compressor 100 according to an embodiment. An upper graph may mean a pressure applied to applied to the upper pins 1351*a*, 1352*a*, and 1353*a* and/or the lower pins 1351*b*, 1352*b*, and 1353*b* of the vanes 1351, 1352, and 1353 in a conventional rotary compressor and a lower graph may mean a pressure applied to the upper pins 1351*a*, 1352*a*, and 1353*a* and/or the lower pins 1351*b*, 1352*b*, and 1353*b* of the vanes 1351, 1352, and 1353 in rotary compressor 100 according to an embodiment. In other words, the load applied to the upper pins 1351*a*, 1352*a*, and 1353*a* and/or the lower pins 1351*b*, 1352*b*, and 1353*b* is reduced, thereby preventing damage to components.

Certain embodiments or other embodiments described above are not mutually exclusive or distinct from each other. The certain embodiments or other embodiments described above may be used in combination or combined with each other in configuration or function.

For example, it is meant that a configuration "A" described in a specific embodiment and/or the drawings and a configuration "B" described in another embodiment and the drawings may be combined with each other. Namely, although the combination between the configurations is not directly described, the combination is possible except in the case where it is described that the combination is impossible.

The aforementioned detailed description should not be construed as restrictive in all terms and should be exemplarily considered. The scope should be determined by rational construing of the appended claims and all modifications within an equivalent scope are included in the scope.

According to embodiments disclosed herein, it is possible to provide a rotary compressor capable of enhancing compression efficiency by preventing contact between a vane and a cylinder. Further, according to embodiments disclosed herein, it is possible to provide a rotary compressor capable of preventing reliability from being deteriorated due to abrasion by preventing contact between the vane and the cylinder. Furthermore, according to embodiments disclosed herein, it is possible to provide a rotary compressor capable of preventing damage to a product by reducing a load applied to a pin of the vane.

Embodiments disclosed herein provide a rotary compressor capable of enhancing compression efficiency by preventing contact between a vane and a cylinder. Embodiments disclosed herein also provide a rotary compressor capable of preventing reliability from being deteriorated due to abrasion by preventing contact between the vane and the cylinder. Embodiments disclosed herein also provide a rotary compressor capable of preventing damage to a product by reducing a load applied to a pin of the vane.

Embodiments disclosed herein provide a rotary compressor that may include a rotational shaft; first and second bearings supporting the rotational shaft in a radial direction; a cylinder disposed between the first bearing and the second bearing, and forming a compression space; a rotor forming a contact point disposed in the compression space and having a predetermined gap with the cylinder, and coupled to the rotational shaft to compress refrigerant according to rotation; and at least one vane slidably inserted into the rotor, and contacting an inner circumferential surface of the cylinder to separate the compression space into a plurality of regions. Each of the at least one vane may include an upper pin extending upward, and a lower pin extending downward. A bottom of the first bearing may include a first rail groove into which the upper pin may be inserted, and a first step portion or step disposed adjacent to the first rail groove, and a top of the second bearing may include a second rail groove into which the lower pin may be inserted, and a second step portion or step disposed adjacent to the second rail groove.

Therefore, compression efficiency may be enhanced by preventing contact between the vane and the cylinder. Further, deterioration in reliability by abrasion may be prevented by preventing the contact between the vane and the cylinder. Moreover, damage to a product may be prevented by reducing a load applied to the pin of the vane.

The first step portion may be disposed between the bottom of the first bearing and the first rail groove, and the second step portion may be disposed between the top of the second bearing and the second rail groove. Further, outermost sides of the first and second step portions may be disposed inside an outer surface of the rotor, and innermost sides of the first and second step portions may be disposed outside the rotational shaft.

The cylinder may include an inlet through which the refrigerant may be suctioned into one region of the compression space, and an outlet disposed on or at a position spaced apart from the inlet in a direction opposite to a rotational direction of the compressor and through which compressed refrigerant may be discharged, and the contact point may be disposed on or at a predetermined position between the inlet and the outlet.

The first step portion and the second step portion may be disposed adjacent to the inlet. Further, widths of the first step portion and the second step portion may become larger as the first and second step portions are closer to the inlet. Furthermore, the first step portion and the second step portion may overlap with each other in an axial direction. Also, a straight line passing through the at least one vane in a direction perpendicular to the rotational shaft may pass through a center of the rotor.

Embodiments disclosed herein provide a rotary compressor that may include a rotational shaft; first and second bearings supporting the rotational shaft in a radial direction; a cylinder disposed between the first bearing and the second bearing, and forming a compression space; a rotor forming a contact point disposed in the compression space and having a predetermined gap with the cylinder and coupled to the rotational shaft to compress refrigerant according to rotation; and at least one vane slidably inserted into the rotor and contacting an inner circumferential surface of the cylinder to separate the compression space into a plurality of regions. Each of the at least one vane may include an upper pin extending upward, and a bottom of the first bearing may include a rail groove into which the upper pin may be inserted and a step portion or step disposed adjacent to the rail groove.

Therefore, compression efficiency may be enhanced by preventing contact between the vane and the cylinder. Further, deterioration in reliability by abrasion may be prevented by preventing contact between the vane and the cylinder. Moreover, damage to a product may be prevented by reducing a load applied to the pin of the vane.

The step portion may be disposed between the bottom of the first bearing and the rail groove. Further, an outermost side of the step portion may be disposed inside an outer surface of the rotor, and an outermost side of the step portion may be disposed outside the rotational shaft.

The cylinder may include an inlet through which the refrigerant may be suctioned into one region of the compression space, and an outlet disposed on or at a position spaced apart from the inlet in a direction opposite to a rotational direction of the compressor and through which compressed refrigerant may be discharged. The contact point may be disposed on or at a predetermined position between the inlet and the outlet.

The step portion may be disposed adjacent to the inlet. A width of the step portion may become larger or increase as the step portion is closer to the inlet.

Embodiments disclosed herein provide a rotary compressor that may include a rotational shaft; first and second bearings supporting the rotational shaft in a radial direction; a cylinder disposed between the first bearing and the second bearing, and forming a compression space; a rotor forming a contact point disposed in the compression space and having a predetermined gap with the cylinder and coupled to the rotational shaft to compress refrigerant according to rotation; and at least one vane slidably inserted into the rotor and contacting an inner circumferential surface of the cylinder to separate the compression space into a plurality of regions. Each of the at least one vane may include a lower pin extending downward, and a top of the second bearing may include a rail groove into which the lower pin may be inserted and a step portion or step disposed adjacent to the rail groove.

Therefore, compression efficiency may be enhanced by preventing contact between the vane and the cylinder. Further, deterioration in reliability by abrasion may be prevented by preventing the contact between the vane and the cylinder. Moreover, damage to a product may be prevented by reducing a load applied to the pin of the vane.

The step portion may be disposed between the top of the second bearing and the rail groove. Further, an outermost side of the step portion may be disposed inside an outer surface of the rotor, and an outermost side of the step portion may be disposed outside the rotational shaft.

The cylinder may include an inlet through which the refrigerant may be suctioned into one region of the compression space, and an outlet disposed on or at a position spaced apart from the inlet in a direction opposite to a rotational direction of the compressor and through which compressed refrigerant may be discharged. The contact point may be disposed on or at a predetermined position between the inlet and the outlet.

The step portion may be disposed adjacent to the inlet. Further, a width of the step portion may become larger or increase as the step portion is closer to the inlet.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a rotational shaft;

first and second bearings that support the rotational shaft in a radial direction;

a cylinder disposed between the first bearing and the second bearing, and forming a compression space;

a rotor forming a contact point, disposed in the compression space, having a predetermined gap with the cylinder, and coupled to the rotational shaft to compress refrigerant according to rotation; and at least one vane slidably inserted into the rotor, and contacting an inner circumferential surface of the cylinder to separate the compression space into a plurality of regions, wherein each of the at least one vane comprises an upper pin that extends upward, and a lower pin that extends downward, wherein a surface of the first bearing comprises a first rail groove into which the upper pin is inserted, wherein a first step is disposed adjacent to the first rail groove, wherein the surface of the first bearing is a bottom of the first bearing, wherein the first step is recessed from the bottom of the first bearing by a first height, the first rail groove defines a space that is at a second height from the bottom of the first bearing, wherein the first height is smaller than the second height, wherein a surface of the second bearing comprises a second rail groove into which the lower pin is inserted, wherein a second step is disposed adjacent to the second rail groove, wherein the surface of the second bearing is a top of the second bearing, wherein the second step is recessed from the top of the second bearing by a third height, wherein the second rail groove defines a space that is at a fourth height from the top of the second bearing, and wherein the third height is smaller than the fourth height.

2. The rotary compressor of claim 1, wherein outermost sides of the first and second steps are disposed radially inward with respect to an outer surface of the rotor, and wherein innermost sides of the first and second steps are disposed radially outward with respect to an outer surface of the rotational shaft.

3. The rotary compressor of claim 1, wherein the cylinder comprises an inlet through which the refrigerant is suctioned into one region of the compression space, and an outlet disposed at a position spaced apart from the inlet in a direction opposite to a rotational direction of the compressor and through which compressed refrigerant is discharged, and wherein the contact point is disposed at a predetermined position between the inlet and the outlet.

4. The rotary compressor of claim 3, wherein the first step and the second step are disposed adjacent to the inlet.

5. The rotary compressor of claim 3, wherein widths of the first step and the second step increase closer to the inlet.

6. The rotary compressor of claim 1, wherein the first step and the second step overlap with each other in an axial direction.

7. The rotary compressor of claim 1, wherein a straight line passing through the at least one vane in a direction perpendicular to the rotational shaft passes through a center of the rotor.

8. A rotary compressor, comprising:

a rotational shaft;

first and second bearings that support the rotational shaft in a radial direction;

a cylinder disposed between the first bearing and the second bearing, and forming a compression space;

a rotor forming a contact point, disposed in the compression space, having a predetermined gap with the cylinder, and coupled to the rotational shaft to compress refrigerant according to rotation; and at least one vane slidably inserted into the rotor and contacting an inner circumferential surface of the cylinder to separate the compression space into a plurality of regions, wherein each of the at least one vane comprises an upper pin that extends upward, wherein a bottom of the first bearing comprises a rail groove into which the upper pin is inserted and a step disposed adjacent to the rail groove, wherein the step is recessed from the bottom of the first bearing by a first height, wherein the rail groove defines a space that is at a second height from the bottom of the first bearing, and wherein the first height is smaller than the second height.

9. The rotary compressor of claim 8, wherein an outermost side of the step is disposed radially inward with respect to an outer surface of the rotor, and wherein an outermost side of the step is disposed radially outward with respect to an outer surface of the rotational shaft.

10. The rotary compressor of claim 8, wherein the cylinder comprises an inlet through which the refrigerant is suctioned into one region of the compression space, and an outlet disposed at a position spaced apart from the inlet in a direction opposite to a rotational direction of the compressor and through which compressed refrigerant is discharged, and wherein the contact point is disposed at a predetermined position between the inlet and the outlet.

11. The rotary compressor of claim 10, wherein the step is disposed adjacent to the inlet.

12. The rotary compressor of claim 10, wherein a width of the step increases closer to the inlet.

13. A rotary compressor, comprising:

a rotational shaft;

first and second bearings that support the rotational shaft in a radial direction;

a cylinder disposed between the first bearing and the second bearing, and forming a compression space;

a rotor forming a contact point, disposed in the compression space, having a predetermined gap with the cylinder, and coupled to the rotational shaft to compress refrigerant according to rotation; and at least one vane slidably inserted into the rotor and contacting an inner circumferential surface of the cylinder to separate the compression space into a plurality of regions, wherein each of the at least one vane comprises a lower pin that extends downward, wherein a top of the second bearing comprises a rail groove into which the lower pin is inserted and a step disposed adjacent to the rail groove, wherein the step is recessed from the top of the second bearing by a third height, wherein the rail groove defines a space that is at a fourth height from the top of the second bearing, and wherein the third height is smaller than the fourth height.

14. The rotary compressor of claim 13, wherein an outermost side of the step is disposed radially inward with respect to an outer surface of the rotor, and wherein an innermost side of the step is disposed radially outward with respect to an outer surface of the rotational shaft.

15. The rotary compressor of claim 13, wherein the cylinder comprises an inlet through which the refrigerant is suctioned into one region of the compression space, and an outlet disposed at a position spaced apart from the inlet in a direction opposite to a rotational direction of the compressor and through which compressed refrigerant is discharged, and wherein the contact point is disposed at a predetermined position between the inlet and the outlet.

16. The rotary compressor of claim 15, wherein the step is disposed adjacent to the inlet.

17. The rotary compressor of claim 15, wherein a width of the step increases closer to the inlet.

* * * * *